US012359363B2

(12) United States Patent
Bae et al.

(10) Patent No.: US 12,359,363 B2
(45) Date of Patent: Jul. 15, 2025

(54) WASHING MACHINE

(71) Applicant: LG Electronics Inc., Seoul (KR)

(72) Inventors: Sanghun Bae, Seoul (KR); Bongjae Kim, Seoul (KR); Sanghyuk Kwon, Seoul (KR); Yicheol Choi, Seoul (KR); Jangseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 808 days.

(21) Appl. No.: 17/527,740

(22) Filed: Nov. 16, 2021

(65) Prior Publication Data

US 2022/0154388 A1 May 19, 2022

(30) Foreign Application Priority Data

Nov. 17, 2020 (KR) ..... 10-2020-0153911

(51) Int. Cl.
*D06F 43/08* (2006.01)
*D06F 43/02* (2006.01)

(52) U.S. Cl.
CPC ..... *D06F 43/085* (2013.01); *D06F 43/02* (2013.01); *D06F 43/081* (2013.01); *D06F 43/083* (2013.01)

(58) Field of Classification Search
CPC ..... D06F 43/085; D06F 43/02; D06F 43/083; D06F 43/081
See application file for complete search history.

(56) References Cited

U.S. PATENT DOCUMENTS 5,667,683 A * 9/1997 Benian ..... B01D 29/684 210/427
5,822,818 A 10/1998 Chao et al.
6,122,941 A 9/2000 McClain et al.
6,237,373 B1 * 5/2001 Harris ..... D06F 43/02 68/18 F
6,351,973 B1 3/2002 McClain et al.
6,474,115 B1 * 11/2002 Preston ..... D06F 43/02 68/140

(Continued)

FOREIGN PATENT DOCUMENTS

CN 202945455 5/2013
GB 700634 12/1953

(Continued)

OTHER PUBLICATIONS

KR101866903 translation (Year: 2018).*

(Continued)

*Primary Examiner* — Michael E Barr
*Assistant Examiner* — Lauren G Orta
(74) *Attorney, Agent, or Firm* — Fish & Richardson P.C.

(57) ABSTRACT

A washing machine is configured to perform washing using carbon dioxide. The washing machine includes a first housing that defines an opening and an inner space, a drum disposed in the inner space of the first housing and configured to receive laundry, a barrier that is coupled to the first housing and seals the opening of the first housing, and a second housing that faces a surface of the barrier and is coupled to the first housing. The barrier defines (i) a first space between the first housing and the barrier from leaking and (ii) a second space between the second housing, where the barrier is configured to block liquid carbon dioxide injected into the first space from leaking into the second space.

15 Claims, 21 Drawing Sheets

(56) References Cited

U.S. PATENT DOCUMENTS

| | | | | |
|---|---|---|---|---|
| 7,841,216 | B2 | 11/2010 | Uhlin | |
| 2002/0004954 | A1* | 1/2002 | Preston | D06F 43/00 134/107 |
| 2004/0020510 | A1 | 2/2004 | Roseen | |
| 2005/0034247 | A1* | 2/2005 | Uhlin | D06F 43/00 8/142 |
| 2007/0277562 | A1 | 12/2007 | Uhlin | |
| 2013/0180057 | A1 | 7/2013 | Babbitt et al. | |

FOREIGN PATENT DOCUMENTS

| | | | | |
|---|---|---|---|---|
| GB | 2141232 | | 12/1984 | |
| JP | 2005313060 | | 11/2005 | |
| KR | 19990048027 | | 7/1999 | |
| KR | 20000016662 | | 3/2000 | |
| KR | 20010096995 | | 11/2001 | |
| KR | 20030046506 | | 6/2003 | |
| KR | 20140123941 | | 10/2014 | |
| KR | 20150056325 | | 5/2015 | |
| KR | 101866903 | B1 * | 6/2018 | D06F 43/08 |
| WO | WO-2008129204 | A2 * | 10/2008 | D06F 43/081 |

OTHER PUBLICATIONS

WO2008129204 translation (Year: 2008).*
Extended European Search Report in European Appln. No. 21208467.7, dated Apr. 5, 2022, 9 pages.
International Search Report and Written Opinion in International Appln. No. PCT/KR2021/016875, dated Mar. 2, 2022, 11 pages.

* cited by examiner

WASHING MACHINE

CROSS-REFERENCE TO RELATED APPLICATIONS

This application claims the benefit of Korean Patent Application No. 10-2020-0153911, filed on Nov. 17, 2020, which is hereby incorporated by reference as if fully set forth herein.

TECHNICAL FIELD

The present disclosure relates to a washing machine, and more particularly to a washing machine for performing laundry treatment such as washing using carbon dioxide ($CO_2$).

BACKGROUND

A washing machine may perform a washing procedure and a rinsing procedure using carbon dioxide ($CO_2$), where the inside of a washing tub of the washing machine may be filled with gaseous carbon dioxide ($CO_2$) and liquid carbon dioxide ($CO_2$). For example, in order to wash laundry using carbon dioxide ($CO_2$), carbon dioxide ($CO_2$) may flow from a storage tub into the washing machine so that the inside of the washing machine can be filled with the carbon dioxide ($CO_2$). After completion of the washing procedure, carbon dioxide ($CO_2$) may be drained from the washing tub to a distillation tub and then flow from the distillation tub into the storage tub, so that the carbon dioxide ($CO_2$) can be reused. In some cases, the washing tub may be configured in a manner that a pulley is connected to a drive shaft, and a motor pulley is connected to a drum pulley through a belt, so that a drum can rotate by the washing tub.

In some cases, where a washing space in which laundry is disposed and a motor space in which a motor is installed are used together without distinction therebetween, the motor space may be filled with carbon dioxide ($CO_2$). As a result, a large amount of carbon dioxide ($CO_2$) may be used in the washing procedure of laundry. In some cases, due to the large amount of carbon dioxide ($CO_2$), pressure vessels related to carbon dioxide ($CO_2$) may have an increased size, and the system may become large and heavy. Therefore, there may be restrictions on the space in which the system is to be installed. In some cases, the drum may not be taken out of the washing space, which may lead to difficulties in providing an operator (or a repairman) with an easy repair environment in which the drum can be easily repaired.

In some cases, a chamber in which a drum is disposed and a chamber in which a motor is disposed may be coupled to each other. Since two chambers are coupled to each, leakage may occur at a coupling portion of the two chambers. In some cases, where the chamber including the motor is separated from the other chamber including the drum, the drum may not be taken out of the washing space, which may hinder a repair operation of the drum by an operator or repairman.

In some cases, the washing machine using carbon dioxide ($CO_2$) may circulate in an external charging cycle, a supplying cycle, a washing cycle, a distillation cycle, and a charging cycle. For example, a storage tank may store liquid carbon dioxide ($CO_2$). To perform washing of laundry, the storage tank may supply liquid carbon dioxide ($CO_2$) to the washing tub. Thereafter, the storage tank may be charged with carbon dioxide ($CO_2$), which is liquefied after distillation. A storage level sensor is located next to the storage tank, so that the storage level sensor detects the height (level) of liquid carbon dioxide ($CO_2$) stored in the storage tank. In more detail, gaseous carbon dioxide ($CO_2$) may be converted into liquid carbon dioxide ($CO_2$) after passing through the compressor, and the liquid carbon dioxide ($CO_2$) may be discharged into the storage tank. In this case, a large difference in pressure may occur in the liquid carbon dioxide ($CO_2$) discharged into the storage tank, so that it may be difficult to measure a storage level of the liquid carbon dioxide ($CO_2$) stored in the storage tank.

In some cases, where an upper part of the storage tank has inlet/output structures through which gaseous carbon dioxide ($CO_2$) flows into the storage tank, the height of the storage tank may become higher, and the overall system size may increase.

SUMMARY

The present disclosure describes a washing machine that can reduce environmental pollution by reducing the amount of carbon dioxide ($CO_2$) used for laundry treatment such as washing.

The present disclosure further describes a washing machine that allows reduction of the size of a pressure vessel designed to use carbon dioxide ($CO_2$) by reducing the amount of the carbon dioxide ($CO_2$) to be used.

The present disclosure further describes a washing machine that can provide the environment in which an operator (or a repairman) can repair the drum that rotates while accommodating laundry.

The present disclosure further describes a washing machine that allows reduction of the size of a space to be occupied by a motor assembly rotating the drum, thereby reducing the size of an overall space to be occupied by the washing machine.

The present disclosure further describes a washing machine that can stably operate by allowing a washing space including the drum and a motor space including the motor to be kept at the same pressure.

The present disclosure further describes a washing machine with an improved storage-tank inlet structure by which a fluid level of liquid carbon dioxide ($CO_2$) flowing into the storage tank may not be affected by movement or evaporation thereof.

The present disclosure further describes a washing machine that enables reduction of the overall height thereof.

According to one aspect of the subject matter described in this application, a washing machine is configured to perform washing using carbon dioxide. The washing machine includes a first housing that defines an opening and an inner space, a drum disposed in the inner space of the first housing and configured to receive laundry, a barrier that is coupled to the first housing and seals the opening of the first housing, and a second housing that faces a surface of the barrier and is coupled to the first housing. The barrier defines (i) a first space between the first housing and the barrier from leaking and (ii) a second space between the second housing, where the barrier is configured to block liquid carbon dioxide injected into the first space from leaking into the second space.

Implementations according to this aspect can include one or more of the following features. For example, the first housing can include a first flange disposed along the opening of the first housing, where the first flange defines a seating groove that is coupled to the barrier and extends along the opening, and the second housing can include a second flange coupled to the first flange.

In some implementations, the washing machine can further include a motor including a rotary shaft, and the barrier defines a first through-hole that receives the rotary shaft, and a second through-hole configured to communicate gaseous carbon dioxide therethrough. In some examples, the second through-hole can be disposed above the first through-hole. In some implementations, the washing machine can include a heat exchanger coupled to the barrier and a refrigerant pipe that passes through the second through-hole and is configured to supply a refrigerant to the heat exchanger.

In some implementations, the barrier can include a heat exchanger disposed in the first space, the heat exchanger being configured to communicate a refrigerant therethrough. In some implementations, the washing machine can include a motor assembly that is coupled to the barrier and that includes a stator, a rotor, and a bearing housing, and a rotary shaft disposed in the bearing housing, the rotary shaft having a first end coupled to the rotor and a second end coupled to the drum. In some examples, the washing machine can further include a sealing portion that is disposed around the rotary shaft and exposed to the first space.

In some examples, the bearing housing can define a communication hole configured to communicate air with an outside of the bearing housing. In some examples, the rotary shaft can define a first flow passage and a second flow passage that are spaced apart from each other, each of the first flow passage and the second flow passage being configured to communicate inflow or outflow of the air therethrough. In some examples, the first flow passage and the second flow passage extend in a radial direction away from a center portion of the rotary shaft. In some examples, the rotary shaft can further define a connection flow passage that connects the first flow passage and the second flow passage to each other. In some implementations, the connection flow passage can be disposed at a center of rotation of the rotary shaft and extend in a direction perpendicular to the radial direction.

In some implementations, the washing machine can include a storage tank configured to store carbon dioxide to be supplied to the drum, a distillation chamber configured to receive liquid carbon dioxide used in the drum, a filter configured to filter contaminants from the liquid carbon dioxide used in the drum, and a compressor configured to reduce gas pressure inside the drum.

In some implementations, the first housing and the second housing are coupled to each other and defines a closed space, and the barrier can divide the closed space into the first space and the second space.

According to another aspect, a washing machine is configured to perform washing using carbon dioxide. The washing machine includes a first housing that defines an opening and an inner space, a drum disposed in the inner space of the first housing and configured to receive laundry, a second housing coupled to the first housing, and a storage tank configured to store carbon dioxide to be supplied to the drum. The storage tank includes a case the defines an exterior of the storage tank, and a supply pipe configured to supply liquid carbon dioxide to the case, where the supply pipe has an outlet disposed higher than a height of the liquid carbon dioxide stored in the case.

Implementations according to this aspect can include one or more of the following features. For example, the washing machine can include a storage level sensor configured to measure the height of the liquid carbon dioxide stored in the case, and the storage tank can have a cylindrical shape having a circular surface, where the circular surface defines a side surface of the storage tank. The supply pipe can pass through a bottom of the case and extend to a position higher than a maximum height of liquid carbon dioxide in the case with respect to the bottom of the case.

In some implementations, the supply pipe can include a plurality of baffles that are alternately arranged in the supply pipe and define a movement path of the liquid carbon dioxide in the supply pipe. In some implementations, the storage tank can further include a cover that has a plurality of holes, the plurality of holes defining the outlet of the supply pipe. In some implementations, the washing machine can include a barrier that is coupled to the first housing or the second housing and seals the opening of the first housing, where the second housing faces a surface of the barrier. The barrier can define (i) a first space between the first housing and the barrier from leaking and (ii) a second space between the second housing, where the barrier can be configured to block liquid carbon dioxide injected into the first space from leaking into the second space.

In some implementations, a washing machine can include a barrier for dividing the inner space of a washing tub into a washing unit and a motor unit such that liquid carbon dioxide used as a washing solvent is not transferred to the motor unit by the barrier. The barrier can be formed as a detachable (or separable) component. In some cases, the motor can be directly mounted to a rotary shaft of a washing drum to minimize a space of the motor unit, so that the amount of carbon dioxide to be used for laundry treatment can be reduced. As a result, a distillation tank and the storage tank can be miniaturized in size, so that the overall size of the washing machine can be reduced.

A through-hole can be installed at an upper portion of the barrier in a manner that the pipe of the heat exchanger disposed at the barrier can penetrate the through-hole. As a result, gaseous carbon dioxide can move to the washing unit and the motor unit, resulting in pressure equilibrium between the washing unit and the motor unit.

The washing machine can include a flow passage that allows liquid carbon dioxide to flow through a lower portion of the storage tank and allows gaseous carbon dioxide to flow through an upper portion of the storage tank.

In some implementations, a supply pipe inserted into the storage tank can be disposed higher than a maximum storage level of liquid carbon dioxide stored in the storage tank. Even when liquid carbon dioxide flows into the storage tank, the liquid carbon dioxide flows down along a top surface of the storage tank, so that the fluid level is not shaken to maintain a stable fluid surface. As a result, the storage level of stored carbon dioxide can be stably measured, so that the washing machine can be controlled with high reliability.

In some implementations, the end of the supply pipe for the inlet through which liquid carbon dioxide is injected into the storage tank can be disposed higher than the maximum fluid level within the storage tank in a manner that liquid carbon dioxide can flow along the inner surface of the storage tank, so that the storage level of liquid carbon dioxide can be stably maintained in the storage tank.

In some implementations, a gas suction unit and a gas discharge unit for the storage tank can be disposed at a side surface of the storage tank. An internal pipe connected to the gas suction/discharge units can be disposed at a top surface of the storage tank such that the height of the storage tank is reduced, resulting in implementation of an overall compact washing machine.

In some implementations, a washing machine can include a first housing configured to include an opening formed therein and a space in which a drum for accommodating laundry is inserted; a barrier configured to seal the opening and coupled to the first housing; and a second housing configured to seal one surface of the barrier and coupled to the first housing. The opening is larger in size than a cross-section of the drum. Thus, an operator can access the drum through the opening so that the operator can maintain and repair the drum.

In some implementations, the opening can be larger in size than a cross-section of the drum. For example, the opening can be larger in size than a maximum cross-section of the drum. In some examples, the opening can be larger in size than a maximum cross-section of a space of the first housing. In some examples, the opening can be maintained at the same size until reaching a center portion of the first housing.

In some implementations, a heat insulation member can be disposed between the heat exchanger and the barrier. For instance, the heat exchanger can include a bracket coupled to the barrier, wherein the bracket is fixed to the barrier by a bolt penetrating the barrier and a cap nut coupled to the bolt.

In some implementations, an O-ring can be disposed at a portion where the bearing housing is coupled to the barrier. The O-ring can prevent liquid carbon dioxide from flowing into a space opposite to the barrier. In some examples, an O-ring cover for preventing separation of the O-ring can be coupled to the O-ring.

DETAILED DESCRIPTION

Figure 1:
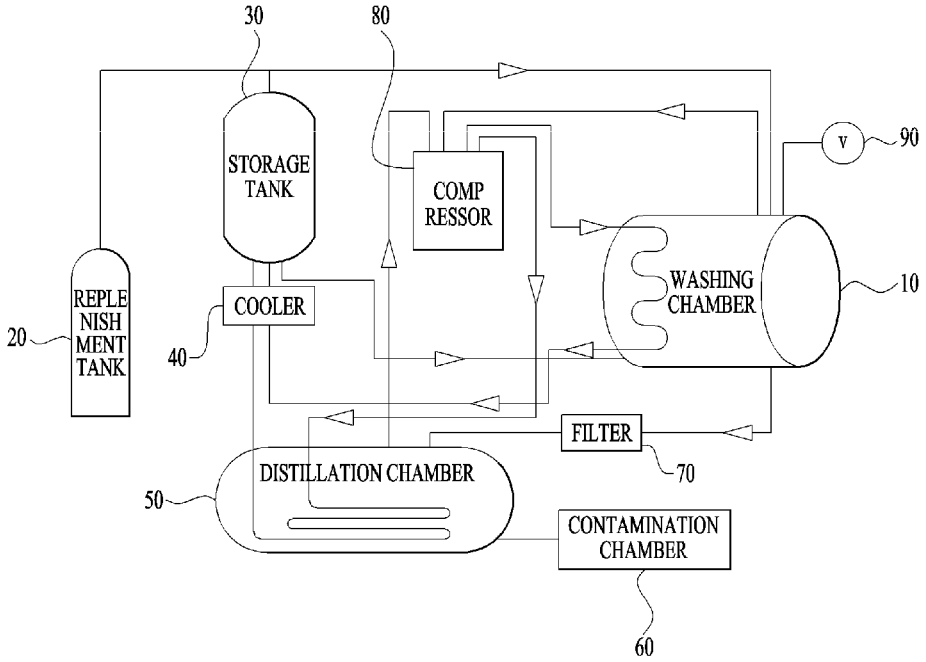
FIG. 1 is a conceptual diagram illustrating an example of a washing machine.

FIG. 1 is a conceptual diagram illustrating an example of a washing machine.

Referring to FIG. 1, the washing machine can perform various laundry treatments (such as washing, rinsing, etc. of laundry) using carbon dioxide ($CO_2$), and the washing machine can include constituent elements capable of storing or processing such carbon dioxide ($CO_2$).

In some implementations, the washing machine can include a supply unit for supplying carbon dioxide, a washing unit for processing laundry, and a recycling unit for processing used carbon dioxide. The supply unit can include a tank for storing liquid carbon dioxide therein, and a compressor for liquefying gaseous carbon dioxide. The tank can include a supplementary tank and a storage tank. The washing unit can include a washing chamber into which carbon dioxide and laundry can be put together. The recycling unit can include a filter for separating contaminants dissolved in liquid carbon dioxide after completion of the washing procedure, a cooler for liquefying gaseous carbon dioxide, a distillation chamber for separating contaminants dissolved in the liquid carbon dioxide, and a contamination chamber for storing the separated contaminants after distillation.

The supplementary tank 20 can store carbon dioxide to be supplied to the washing chamber 10. In some implementations, the supplementary tank 20 can be a storage tank that can be used from replenishment of carbon dioxide. In some implementations, the supplementary tank 20 may not be installed in the washing machine in a situation where replenishment of such carbon dioxide is not performed. In some examples, the supplementary tank may not be provided in a normal situation, and the supplementary tank can be coupled to supplement carbon dioxide as needed, so that replenishment of carbon dioxide is performed. In some examples, when such replenishment of carbon dioxide is completed, the supplementary tank can be separated from the washing machine.

The storage tank 30 can supply carbon dioxide to the washing chamber 10, and can store the carbon dioxide recovered through the distillation chamber 50.

The cooler 40 can re-liquefy gaseous carbon dioxide, and can store the liquid carbon dioxide in the storage tank 30.

The distillation chamber 50 can distill liquid carbon dioxide used in the washing chamber 10. The distillation chamber 50 can separate contaminants by vaporizing the carbon dioxide through the distillation process, and can remove the separated contaminants.

In some examples, the compressor 80 can reduce pressure of the inside of the pressurized washing chamber 10 to approximately 1.5 bar. The air intake portion of the compressor 80 can be connected to the washing chamber 10, and the exhaust portion of the compressor 48 can be connected to a chamber heat exchange tube located inside the washing chamber 20.

The contamination chamber 60 can store contaminants filtered through distillation by the distillation chamber 50.

The filter unit 70 can filter out contaminants in the process of discharging liquid carbon dioxide used in the washing chamber 10 into the distillation chamber 50.

The filter unit 70 can include a filter having a plurality of fine holes.

Laundry is put in the washing chamber 10, so that washing or rinsing of the laundry is performed. When a valve of the storage tank 30 connected to the washing chamber 10 opens a flow passage, air pressure in the washing chamber 10 becomes similar to air pressure in the storage tank 30.

At this time, gaseous carbon dioxide is injected first, and then the inside of the washing chamber 10 is pressurized through equipment such as a pump, so that the inside of the washing chamber 10 can be filled with liquid carbon dioxide. In a situation in which the inside of the washing chamber 10 is maintained at approximately 45~51 bar and 10~15° C., washing can be performed for 10~15 minutes, and rinsing can be performed for 3~4 minutes. When washing or rinsing is completed, liquid carbon dioxide is discharged from the washing chamber 10 to the distillation chamber 50.

The valve 90 can remove internal air of the washing chamber 10 before starting the washing procedure, thereby preventing moisture from freezing in the washing chamber 10. Because washing performance is deteriorated when moisture in the washing chamber 10 is frozen, moisture in the washing chamber 10 can be prevented from being frozen.

Figure 2:
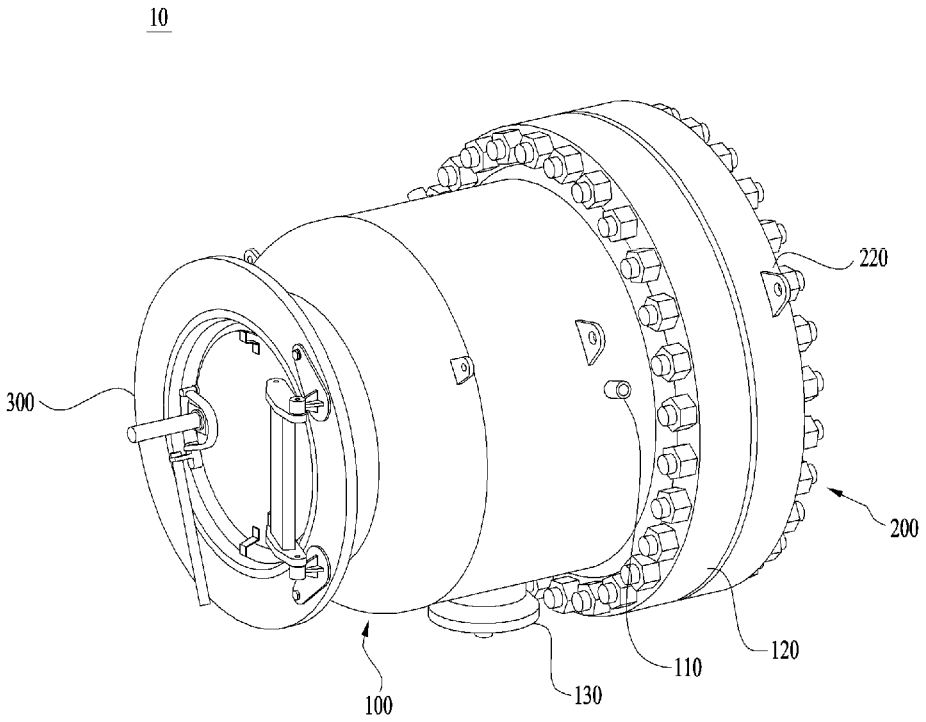
FIG. 2 illustrates an example of a washing chamber.
Figure 3:
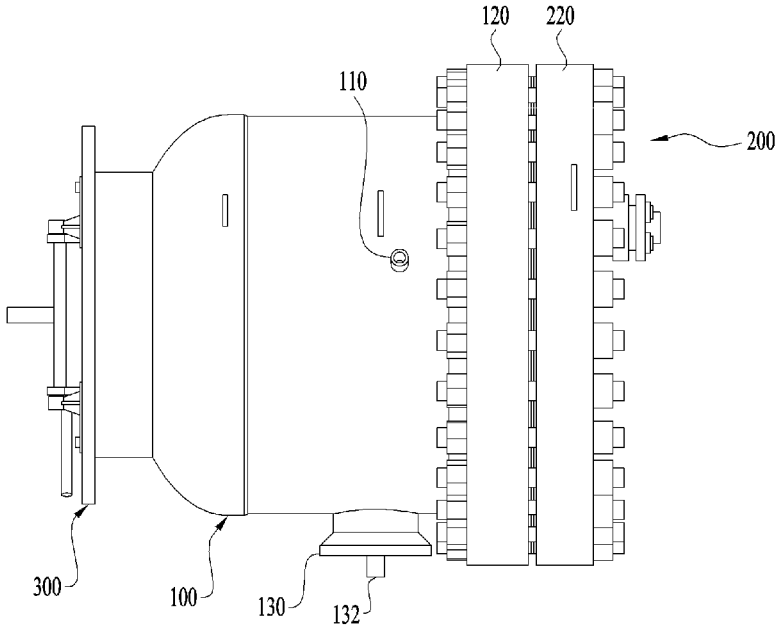
FIG. 3 is a front view illustrating the structure shown in FIG. 2.
Figure 4:
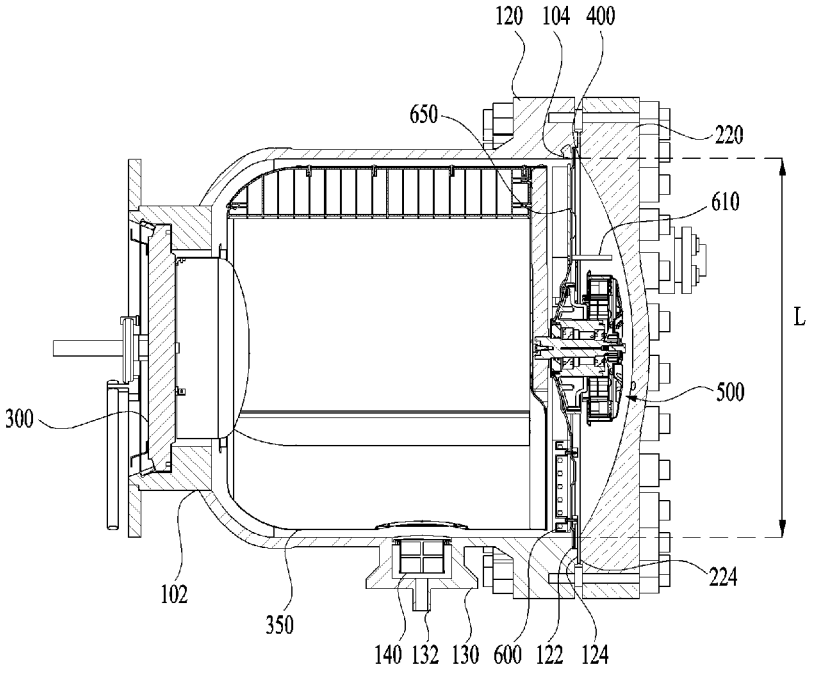
FIG. 4 is a cross-sectional view illustrating the structure shown in FIG. 2.

FIG. 2 illustrates an example appearance of the washing chamber. FIG. 3 is a front view illustrating the structure shown in FIG. 2. FIG. 4 is a cross-sectional view illustrating the structure shown in FIG. 2.

Referring to FIGS. 2 to 4, the washing chamber 10 can include a door 300, a first housing 100, and a second housing. In this case, the washing chamber 10 can refer to a space in which laundry is disposed and various laundry treatments such as washing, rinsing, etc. of laundry can be performed. In addition, the washing chamber 10 can be provided with a motor assembly that supplies driving force capable of rotating the drum to the washing chamber 10.

The door 300 can be provided at one side of the first housing 100 to open and close the inlet 102 provided in the first housing 100. When the door 300 opens the inlet 102, the user can put laundry to be treated into the first housing 100 or can take the completed laundry out of the first housing 100.

The first housing 100 can be formed with a space in which the drum 350 accommodating laundry is inserted. The drum 350 is rotatably provided so that liquid carbon dioxide and laundry are mixed together in a state in which laundry is disposed in the drum 350.

The first housing 100 can be provided with an opening 104 in addition to the inlet 102. The opening 104 can be located opposite to the inlet 102, and can be larger in size than the inlet 102.

The first housing 100 can be formed in an overall cylindrical shape, the inlet 102 formed in a circular shape can be formed at one side of the first housing 100, and the opening 104 formed in a circular shape can be provided at the other side of the first housing 100.

The drum 350 can be formed in a cylindrical shape similar to the shape of the inner space of the first housing 100, so that the drum 350 can rotate clockwise or counterclockwise in the first housing 100.

The opening 104 can be larger in size than the cross-section of the drum 350, so that the operator or user can repair the drum by removing the drum 350 through the opening 104. In this case, the opening 104 can be larger in size than a maximum cross-section of the drum 350. Therefore, the operator or the user can open the opening 104 to take out the drum 350. It is also possible to install the drum 350 in the first housing 100 through the opening 104.

The opening 104 can be larger in size than the maximum cross-section of the space of the first housing 100. In addition, the opening 104 can be maintained at the same size while extending to the center portion of the first housing 100. Thus, when the operator or the user removes the drum 350 from the first housing 100 or inserts the drum 350 into the first housing 100, a space sufficient to avoid interference with movement of the drum 350 can be provided.

In some implementations, the user can put laundry into the first housing 100 using the inlet 102, and maintenance or assembly of the drum 350 can be achieved using the opening 104. The inlet 102 and the opening 104 can be located opposite to each other in the first housing 100.

The first housing 100 can be provided with an inlet pipe 110 through which carbon dioxide flows into the first housing 100. The inlet pipe 110 can be a pipe that is exposed outside the first housing 100, so that the pipe through which carbon dioxide flows can be coupled to the constituent elements described in FIG. 1.

The first housing 100 can be provided with the filter fixing part 130 capable of fixing the filter unit 70. The filter fixing part 130 can be formed to radially protrude from the cylindrical shape of the first housing 100, resulting in formation of a space in which the filter can be inserted. The filter fixing part 130 can be provided with a discharge pipe 132 through which carbon dioxide filtered through the filter unit 70 can be discharged from the first housing 100. The carbon dioxide used in the first housing 100 can be discharged outside the first housing 100 through the discharge pipe 132.

The first housing 100 can include a first flange 120 formed along the opening 104. The first flange 120 can extend in a radial direction along the outer circumferential surface of the first housing 100 in a similar way to the cylindrical shape of the first housing 100. The first flange 120 can be evenly disposed along the circumference of the first housing 100 in a direction in which the radius of the first housing 100 increases.

The second housing 200 can be coupled to the first housing 100 to form one washing chamber. At this time, the washing chamber can provide a space in which laundry treatment is performed and a space in which a motor assembly for providing driving force for rotating the drum is installed.

The second housing 200 can include a second flange 220 coupled to the first flange 120. The second housing 200 can be formed to have a size similar to the cross-section of the first housing 100, and can be disposed at the rear of the first housing 100.

The second flange 220 can be coupled to the first flange 120 by a plurality of bolts, so that the internal pressure of the washing chamber can be maintained at pressure greater than the external atmospheric pressure in a state in which the second housing 200 is fixed to the first housing 100.

The first filter fixing part 130 provided in the first housing 100 can be provided with a filter 140 for filtering foreign substances. The filter 140 can include a plurality of small holes that block foreign substances and allow liquid carbon dioxide to pass therethrough, so that the liquid carbon dioxide can be discharged outside the first housing 100 through the discharge pipe 132.

In some implementations, a barrier 400 for sealing the opening 104 while coupling to the first housing 100 can be provided. The barrier 400 is able to seal the one side of the second housing 200.

In the left space on the basis of the barrier 400 in the structure shown in FIG. 4, the drum 350 can be disposed so that laundry and liquid carbon dioxide are mixed together and laundry treatment such as washing or rinsing can be performed in the drum 350. In some examples, the motor assembly 500 can be disposed in the right space on the basis of the barrier 400, thereby providing driving force capable of rotating the drum 350. In this case, a portion of the motor assembly 500 can be coupled to the drum 350 after passing through the barrier 400.

The barrier 400 can be larger in size than the opening 104, and can be disposed to be in contact with the opening 104, thereby sealing the opening 104. The barrier 400 and the opening 104 can be formed to have a substantially circular shape similar to the shape of the first housing 100, and the diameter L of the opening 104 can be smaller than the diameter of the barrier 400. The diameter L of the opening 104 can be larger than the diameter of the drum 350. Therefore, the cross-section of the drum 350 can be formed to have the smallest size, the cross-section of the opening 104 can be formed to have a medium size, and the barrier 400 can be formed to have the largest size.

The barrier 400 can be arranged to have a plurality of steps, thereby guaranteeing sufficient strength.

The first flange 120 can be provided with a seating groove 122 coupled to the barrier 400 so that the seating groove 122 can be formed along the opening 104. That is, the seating groove 122 can be provided at a portion extending in a radial direction from the opening 104. The seating groove 122 can be recessed by a thickness of the barrier 400 so that the first flange 120 and the second flange 220 are formed to contact each other. The seating groove 122 can be formed to have the same shape as the outer circumferential surface of the barrier 400. Thus, when the barrier 400 is seated in the seating groove 122, the surface of the first flange 120 becomes flat.

The first flange 120 can include the first seating surface 124 extending in a more radial direction than the circumference of the seating groove 122, and the second flange 220 can include a second seating surface 224 coupled to the first seating surface 124 in surface contact with the first seating surface 124. The first seating surface 124 and the second seating surface 224 can be disposed to be in contact with each other, so that carbon dioxide injected into the inner space of the first housing 100 can be prevented from being disposed outside the first housing 100. The first seating surface 124 and the second seating surface 224 can be in surface contact with each other while being disposed at the outer circumferential surfaces of the first housing 100 and the second housing 200, and at the same time can provide a coupling surface where two housings can be bolted to each other.

A heat exchanger 600 in which refrigerant flows can be disposed at the barrier 400. The heat exchanger 600 can be disposed in a space formed by the first housing 100 and the barrier 400. The heat exchanger 600 can change a temperature of the space formed by the first housing 100. The temperature of the space formed by the first housing 100 can be reduced so that humidity of the inner space of the first housing 100 can be lowered.

A heat insulation member (or an insulation member) 650 can be disposed between the heat exchanger 600 and the barrier 400. The heat insulation member 650 can help to prevent the temperature of the heat exchanger 600 from being directly transferred to the barrier 400. The heat insulation member 650 can allow the barrier 400 to be less affected by the temperature change of the heat exchanger 600. The heat insulation member 650 can be formed similar to the shape of the heat exchanger, thereby covering the entire surface of the heat exchanger 600.

Figure 5:
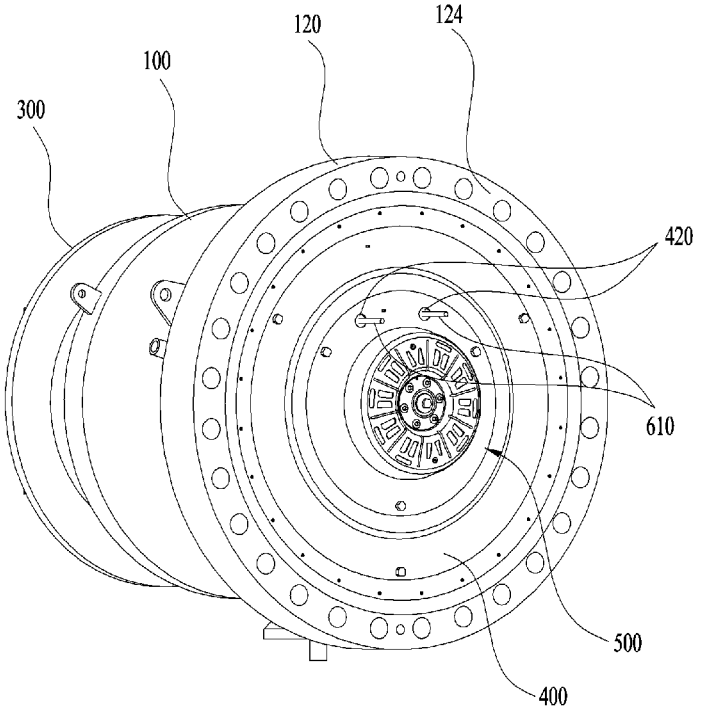
FIG. 5 is a diagram illustrating an example of a second housing separated from the structure shown in FIG. 2.
Figure 6:
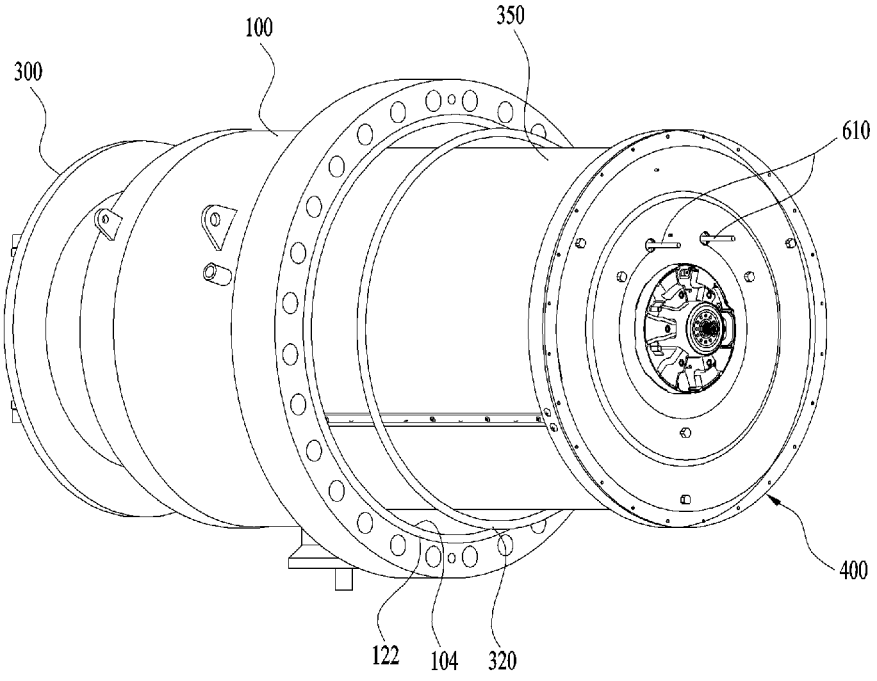
FIG. 6 is a diagram illustrating example parts of a drum shown in FIG. 5, which are detached rearward of the drum.

FIG. 5 is a diagram illustrating the second housing separated from the structure shown in FIG. 2. FIG. 6 is a diagram illustrating example parts of the drum shown in FIG. 5 that are detached rearward from the drum.

Referring to FIGS. 5 and 6, when the second housing 200 is separated from the first housing 100, the barrier 400 can be exposed outside. Since the barrier 400 is coupled to the seating groove of the first housing 100, the inner space of the first housing may not be exposed outside even when the second housing 200 is separated from the first housing 100. The barrier 400 can be coupled to the second housing 200 by a plurality of bolts or the like.

A motor assembly 500 can be coupled to the center portion of the barrier 400, and a second through-hole 420 can be formed at an upper side of the motor assembly 500. A refrigerant pipe 610 for circulating a refrigerant in the heat exchanger 600 can be formed to pass through the second through-hole 420.

When the barrier 400 is separated from the first housing 100, the opening 104 can be exposed outside. At this time, the drum 350 can be withdrawn to the outside through the opening 104. As the opening 104 is larger in size than the drum 350, maintenance of the drum 350 is possible through the opening 104.

A gasket 320 can be disposed between the barrier 400 and the seating groove 122. As a result, when the barrier 400 is coupled to the first housing 100, carbon dioxide can be prevented from leaking between the barrier 400 and the first housing 100. When the barrier 400 is seated in the seating groove 122, the barrier 400 can be coupled to the first housing 100 by the plurality of bolts while compressing the gasket 320. A plurality of coupling holes through which the barrier 400 is coupled to the first housing 100 can be evenly disposed along the outer circumferential surface of the barrier 400.

Figure 7:
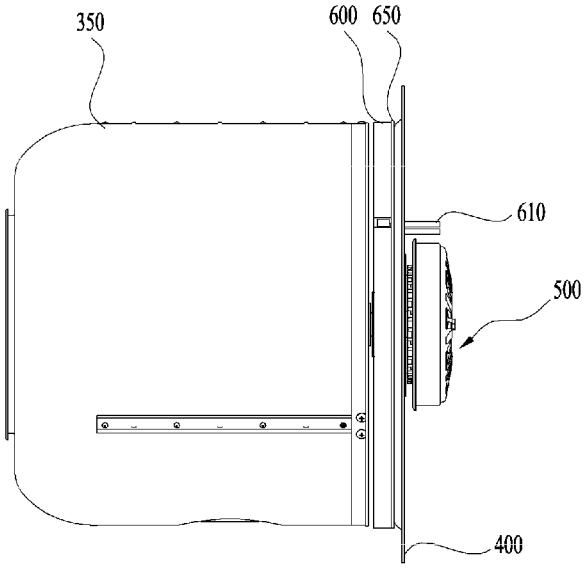
FIG. 7 is a diagram illustrating the drum and some example elements included in the drum.
Figure 8:
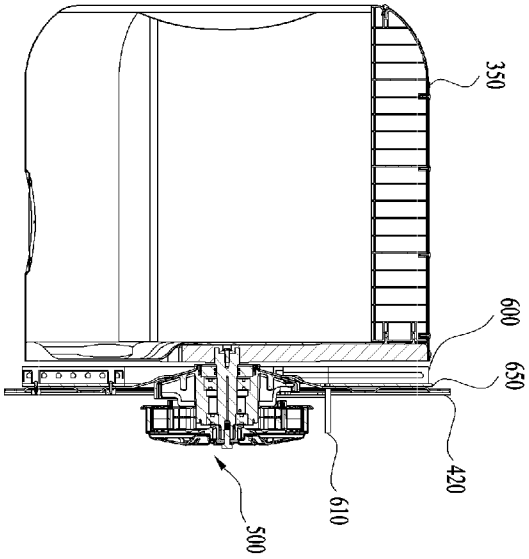
FIG. 8 is a cross-sectional view illustrating the structure shown in FIG. 7.
Figure 9:
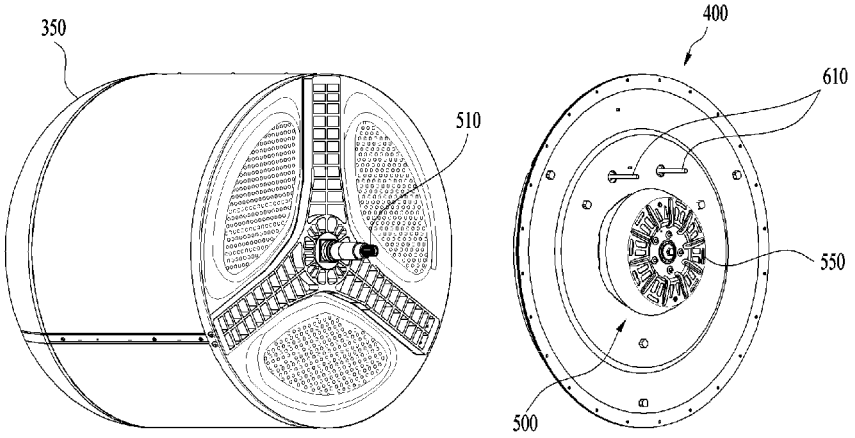
FIG. 9 is an exploded perspective view illustrating the structure shown in FIG. 7.
Figure 10:
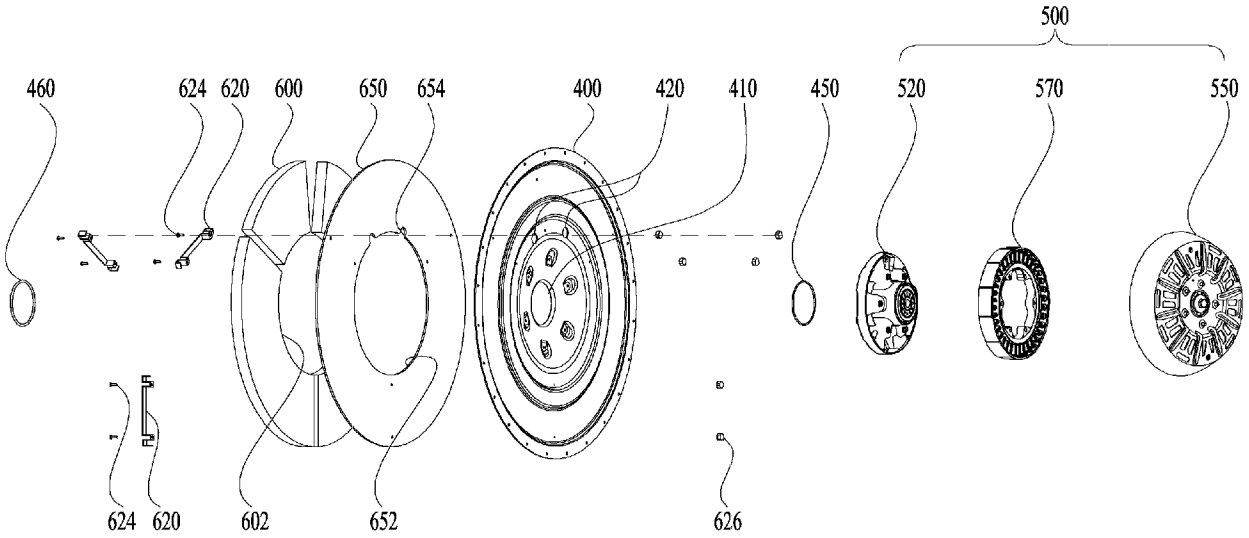
FIG. 10 is an exploded perspective view illustrating example elements of the structure shown in FIG. 7.

FIG. 7 is a diagram illustrating examples of a drum and example elements of the drum. FIG. 8 is a cross-sectional view illustrating the structure shown in FIG. 7. FIG. 9 is an exploded perspective view illustrating the structure shown in FIG. 7. FIG. 10 is an exploded perspective view illustrating example elements of the structure shown in FIG. 7.

As can be seen from FIGS. 7 and 8, the first housing 100 is removed so that the drum 350 is exposed outside. The drum 350 can be formed in a cylindrical shape such that laundry put into the drum 350 through the inlet 102 is movable into the drum 350.

In the left side from the barrier 400, the drum 350, the heat exchanger 600, and the heat insulation member 650 can be disposed. In the right side from the barrier 400, the motor assembly 500 can be disposed.

FIG. 9 is an exploded perspective view illustrating that the drum 350 and the barrier 400 are separated from each other. Referring to FIG. 9, the rotary shaft 510 of the motor assembly 500 can be coupled to the drum 350 at the rear of the drum 350. Therefore, when the rotary shaft 510 rotates, the drum 350 can also be rotated thereby. In addition, when the rotational direction of the rotary shaft 510 is changed, the rotational direction of the drum 350 is also changed.

Since the motor assembly 500 is coupled to the barrier 400, the driving force for rotating the drum 350 may not be transmitted to the drum 350 through a separate belt or the like. As a result, in some examples, rotational force of the motor is directly transmitted to the drum 350, so that loss of force or occurrence of noise can be reduced.

FIG. 10 is an exploded perspective view illustrating example elements installed at the barrier shown in FIG. 9.

Referring to FIG. 10, the heat exchanger 600 can be formed in a doughnut shape similar to the shape of the opening 104. A circular through-hole 602 can be formed at the center of the heat exchanger 600 so that the rotary shaft 510 of the motor can pass through the through-hole 602.

The heat insulation member 650 can be formed in a shape corresponding to the heat exchanger 600, and can help to prevent the temperature change generated in the heat exchanger 600 from being transferred to the barrier 400. The heat insulation member 650 can be made of a material having low thermal conductivity, and can be disposed between the heat exchanger 600 and the barrier 400. A circular through-hole 652 can be formed at the center of the heat insulation member 650 so that the rotary shaft 510 of the motor can pass through the through-hole 652.

The circular shape of the through-hole 602 of the heat exchanger 600 can be similar in size to the circular shape of the through-hole 652 of the heat insulation member 650. However, the through-hole 652 can be formed with a through-groove 654 through which the refrigerant pipe 610 for supplying refrigerant to the heat exchanger 600 can pass.

The heat exchanger 600 can include a bracket 620 coupled to the barrier 400. The bracket 620 can be fixed to the barrier 400 by both a bolt 624 penetrating the barrier 400 and a cap nut 626 coupled to the bolt 624.

The bracket 620 can be formed in a three-dimensionally stepped shape such that the bracket 620 is disposed at a surface where the heat exchanger 600 has a thin thickness. The bolt 624 can be disposed at the stepped groove portion, and can be coupled to the cap nut 626.

The plurality of brackets 620 can be provided, so that the heat exchanger 600 and the heat insulation member 650 can be coupled to the barrier 400 at a plurality of points. In some examples, as illustrated in FIG. 10, three brackets 620 are used for convenience of description. In some examples, a larger number of brackets or a smaller number of brackets than the three brackets can also be used. The plurality of brackets can be evenly disposed at various positions of the heat exchanger 600, so that the heat exchanger 600 can be more stably fixed.

The motor assembly 500 can be coupled to the barrier 400. The motor assembly 500 can include a stator 570, a rotor 550, and a bearing housing 520. The bearing housing 520 can include the rotary shaft 510. One end of the rotary shaft 510 can be coupled to the rotor 550, and the other end of the rotary shaft 510 can be coupled to the drum 350. Therefore, as the rotor 550 rotates around the stator 570, the rotary shaft 510 is also rotated.

The stator 570 is fixed to a bearing housing 520, thereby providing the environment in which the rotor 550 can rotate.

When the bearing housing 520 is coupled to the barrier 400, an O-ring 450 can be disposed between the bearing housing 520 and the barrier 400, so that liquid carbon dioxide injected into the first housing 100 is prevented from flowing into a gap between the barrier 400 and the bearing housing 520. At this time, an O-ring cover 460 can be disposed to improve the coupling force of the O-ring 450. The O-ring cover 460 can be formed similar in shape to the O-ring 450. The O-ring cover 460 can reduce the size of one surface where the O-ring 450 is exposed to one side of the barrier 400, thereby more strongly sealing the gap.

Figure 11A:
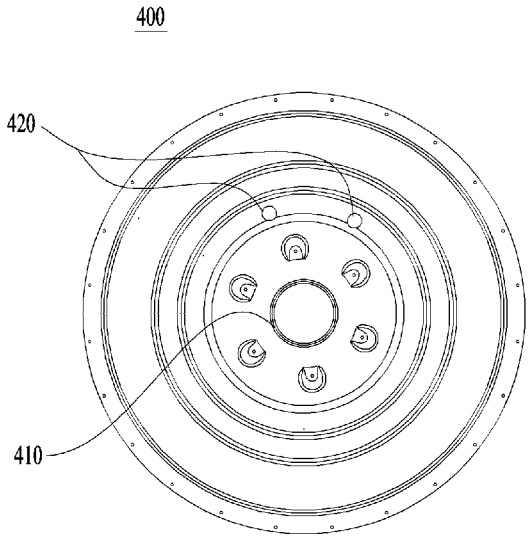
FIGS. 11A and 11B are diagrams illustrating an example of a barrier.
Figure 11B:
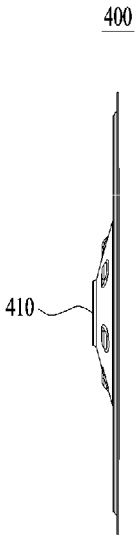

FIGS. 11A and 11B are diagrams illustrating the barrier 400. FIG. 11A is a front view of the barrier 400, and FIG. 11B is a side cross-sectional view of the center portion of the barrier 400.

As can be seen from the side cross-sectional view of the barrier 400, since the barrier 400 includes a plurality of step differences, the barrier 400 can provide sufficient strength by which the heat exchanger 600 can be fixed to one side of the barrier 400 and the motor assembly 500 can be fixed to the other side of the barrier 400.

A first through-hole 410 through which the rotary shaft 510 of the motor passes can be disposed at the center of the barrier 400. The first through-hole 410 can be formed in a circular shape, so that no contact occurs at the rotary shaft 510 passing through the first through-hole 410.

The barrier 400 can include a second through-hole 420 through which gaseous carbon dioxide moves. The second through-hole 420 can be disposed at a higher position than the first through-hole 410. The second through-hole 420 can be disposed to allow the refrigerant pipe 610 to pass therethrough. The second through-hole 420 can be larger in size than the first through-hole 410.

Here, the second through-hole 420 can be implemented as two separate holes. The second through-holes 420 can be disposed symmetrical to each other with respect to the center point of the barrier 400.

The barrier 400 can be a single component capable of being separated from the first housing 100 or the second housing 200, and can provide a coupling structure between the heat exchanger 600 and the motor assembly 500.

In addition, when the barrier 400 is separated from the first housing 100, the environment in which the user or operator can separate the drum 350 from the first housing 100 can be provided.

The barrier 400 can be formed to have a plurality of step differences in a forward or backward direction, and can sufficiently increase the strength. In addition, the barrier 400 can be formed to have a curved surface within some sections, so that the barrier 400 can be formed to withstand force generated in various directions. The outermost portion of the barrier 400 can be coupled to the seating groove 122 of the first housing 100.

Referring to the direction from the outermost part of the barrier 400 to the center part of the barrier 400 as shown in FIG. 11B, the barrier 400 can be formed to have step differences in various directions (e.g., the barrier first protrudes to the left side, protrudes to the right side, and again protrudes to the left side) by various lengths, thereby increasing strength.

Figure 12:
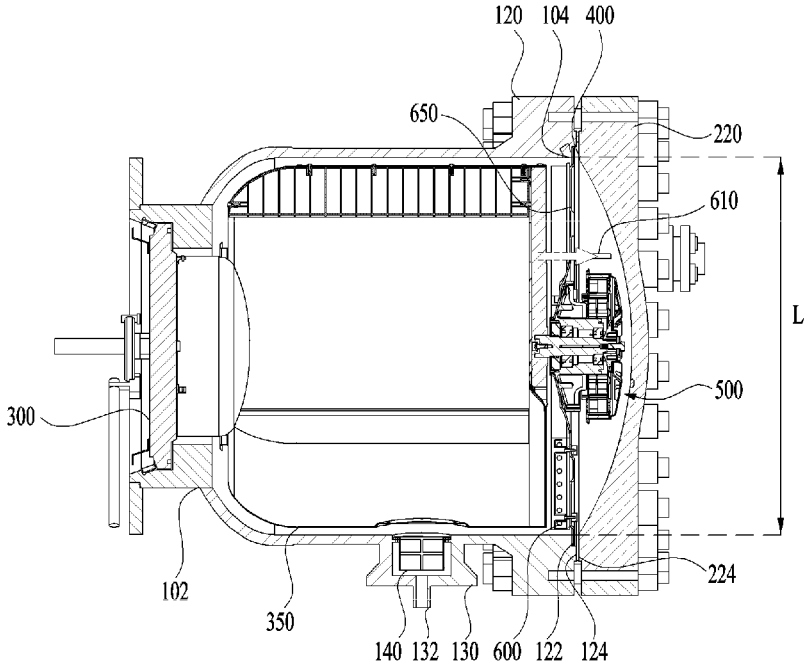
FIG. 12 is a diagram illustrating an example function of a second through-hole.

FIG. 12 is a diagram illustrating the function of the second through-hole.

Referring to FIG. 12, carbon dioxide can be injected into the drum 350 to perform washing of laundry. In this case, the carbon dioxide can be a mixture of liquid carbon dioxide and gaseous carbon dioxide. Since the liquid carbon dioxide is heavier than the gaseous carbon dioxide, the liquid carbon dioxide can be located below the gaseous carbon dioxide, and the gaseous carbon dioxide can be present in the empty space located over the liquid carbon dioxide.

By rotation of the drum 350, laundry disposed in the drum 350 can be mixed with liquid carbon dioxide.

The barrier 400 can help to prevent liquid carbon dioxide injected into the space formed by both the first housing 100 and the barrier 400 from flowing into the other space formed by both the second housing 200 and the barrier 400. That is, since the barrier 400 seals the opening 104, liquid carbon dioxide cannot move to the opposite side of the barrier 400.

During laundry treatment such as washing, the space formed by the first housing 100 and the barrier 400 is separated from the space formed by the second housing 200 and the barrier 400. In this case, the space formed by the first housing 100 and the barrier 400 can be filled with liquid carbon dioxide and gaseous carbon dioxide at a higher pressure than atmospheric pressure. Therefore, in order to stably maintain the pressure of the washing chamber, only gaseous carbon dioxide rather than liquid carbon dioxide can move into the space formed by the second housing 200 and the barrier 400, resulting in implementation of pressure equilibrium.

At this time, gaseous carbon dioxide can pass through the barrier 400 through the second through-hole 420 provided at the barrier 400. However, since the second through-hole 420 is located higher in height than the liquid carbon dioxide, the gaseous carbon dioxide cannot move through the second through-hole 420.

In some cases, the amount of liquid carbon dioxide used in washing or rinsing of laundry may not exceed half of the total capacity of the drum 350. In other words, the amount of liquid carbon dioxide may not exceed the height of the rotary shaft 510 coupled to the drum 350.

Therefore, if the second through-hole 420 is located higher than the rotary shaft 510, gaseous carbon dioxide may not move through the second through-hole 420. However, since the space formed by the first housing 100 and the barrier 400 is filled with gaseous carbon dioxide, the gaseous carbon dioxide can freely flow into the space formed by the second housing 200 and the barrier 400, resulting in implementation of pressure equilibrium.

That is, during laundry treatment such as washing or rinsing, gaseous carbon dioxide and liquid carbon dioxide can be mixed with each other in the space partitioned by the first housing 100 and the barrier 400. In some examples, liquid carbon dioxide may not be present in the space partitioned by the second housing 200 and the barrier 400, and only gaseous carbon dioxide can be present in the space partitioned by the second housing 200 and the barrier 400. Since two spaces are in a pressure equilibrium state therebetween, liquid carbon dioxide need not be present in the space formed by the second housing 200 and the barrier 400, and the amount of used liquid carbon dioxide can be reduced in the space formed by the second housing 200 and the barrier 400. Therefore, the total amount of carbon dioxide to be used in washing or rinsing of laundry can be reduced, so that the amount of carbon dioxide to be used can be greatly reduced compared to the prior art. As a result, the amount of carbon dioxide to be reprocessed after use can also be reduced. As described above, the amount of carbon dioxide to be used can be reduced, so that a storage capacity of the tank configured to store carbon dioxide and the overall size of the washing machine configured to use carbon dioxide can also be reduced. In addition, since the amount of carbon dioxide to be reprocessed after use is reduced, the time to perform washing or rinsing can also be reduced.

Figure 13:
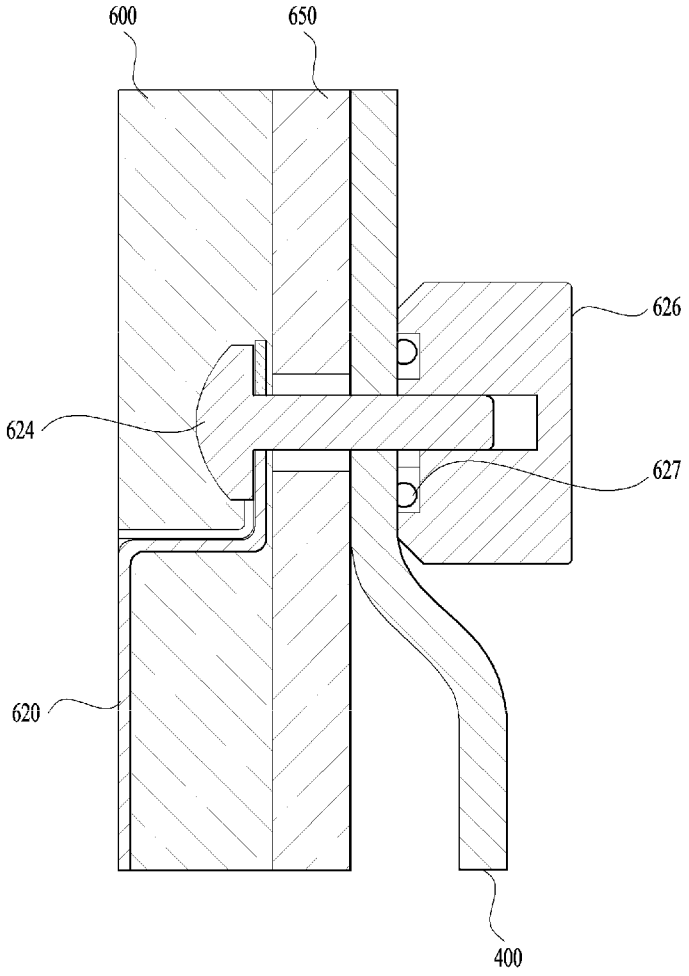
FIG. 13 is a diagram illustrating an example of a heat exchanger coupled to a barrier.

FIG. 13 is a diagram illustrating a structure in which the heat exchanger is coupled to the barrier.

FIG. 13 is a cross-sectional view of a portion in which the bracket 620 is in contact with the heat exchanger 600.

The bracket 620 can be formed in a stepped shape, and the stepped portion is in contact with the heat exchanger 600, so that the heat exchanger 600 can be fixed. The protruding portion can be disposed to contact the heat insulation member 650.

The bolt 624 can be fixed to the protruding portion, and the bolt 624 can pass through the heat insulation member 650 and the barrier 400. A cap nut 626 can be provided at the opposite side of the bolt 624, so that the bolt 624 can be fixed by the cap nut 626. The cap nut 626 can be in contact with the plurality of points of the barrier 400, so that the fixing force at the barrier 400 can be guaranteed.

The cap nut 626 can be formed in a rectangular parallelepiped shape, and a coupling groove can be formed at a portion contacting the barrier 400. A sealing 627 can be disposed in the coupling groove to seal a gap when the cap nut 626 is coupled to the barrier 400. That is, when the cap nut 626 is coupled to the bolt 624, the sealing 627 is pressed so that the bolt 624 can be fixed while being strongly pressurized by the cap nut 626. At this time, the barrier 400 is also pressed together, a hole through which the bolt 624 passes can be sealed.

The bracket 620 can be implemented as a plurality of brackets, so that the heat exchanger 600 can be fixed at various positions. Although the shape of the brackets 620 can be changed when viewed from each direction, the same method for coupling the bracket 620 by the bolt and the cap nut can be applied to the brackets 620.

Figure 14:
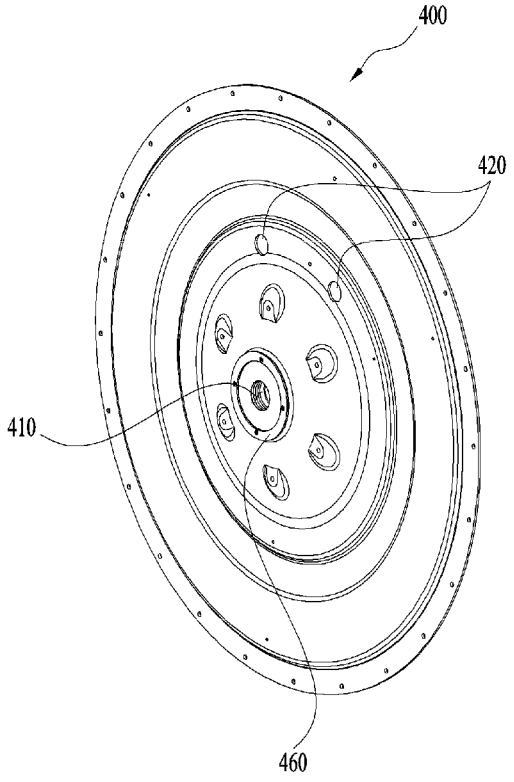
FIG. 14 is a diagram illustrating examples of an O-ring and an O-ring cover mounted to the barrier.
Figure 15:
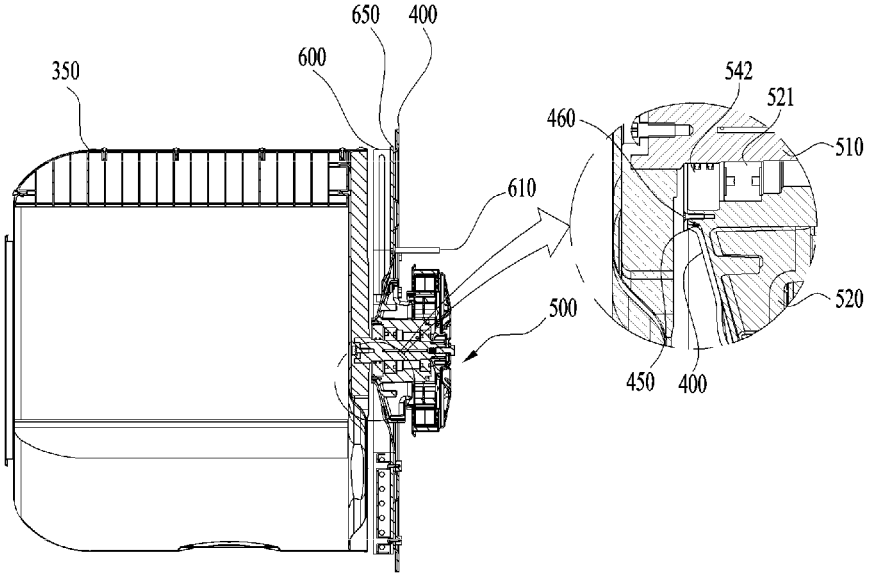
FIG. 15 is a diagram illustrating an example state in which the structure of FIG. 14 is coupled to other elements.

FIG. 14 is a diagram illustrating the O-ring and the O-ring cover mounted to the barrier. FIG. 15 is a diagram illustrating an exemplary state in which the structure of FIG. 14 is coupled to other constituent elements.

The O-ring 450 can be disposed at a portion where the bearing housing 520 is coupled to the barrier 400. The O-ring 450 can help to prevent liquid carbon dioxide from flowing into the space opposite to the barrier 400.

That is, since the rotary shaft 510 is disposed to penetrate the first through-hole 410 of the barrier 400, the gap should exist in the first through-hole 410. Since the rotary shaft 510 rotates, the rotary shaft 510 should be spaced apart from the first through-hole 410 by a predetermined gap, and this predetermined gap cannot be sealed. Therefore, the bearing housing 520 is coupled to the barrier 400, and the gap between the bearing housing 520 and the barrier 400 is sealed by the O-ring 450, so that carbon dioxide can be prevented from moving through the gap sealed by the O-ring 450.

The O-ring 450 can be coupled to the O-ring cover 460 preventing separation of the O-ring 450. The O-ring cover 460 can surround one surface of the O-ring 450, so that the O-ring cover 460 can help to prevent the O-ring 450 from being exposed to a space provided by the first housing 100. Therefore, the O-ring cover 460 can help to prevent the O-ring 450 from being separated by back pressure.

Figure 16:
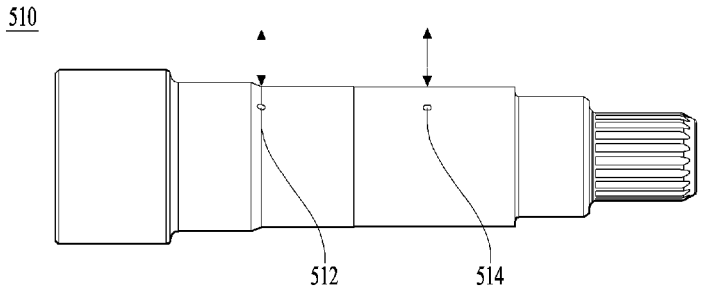
FIG. 16 is a diagram illustrating an example of a rotary shaft.
Figure 17:
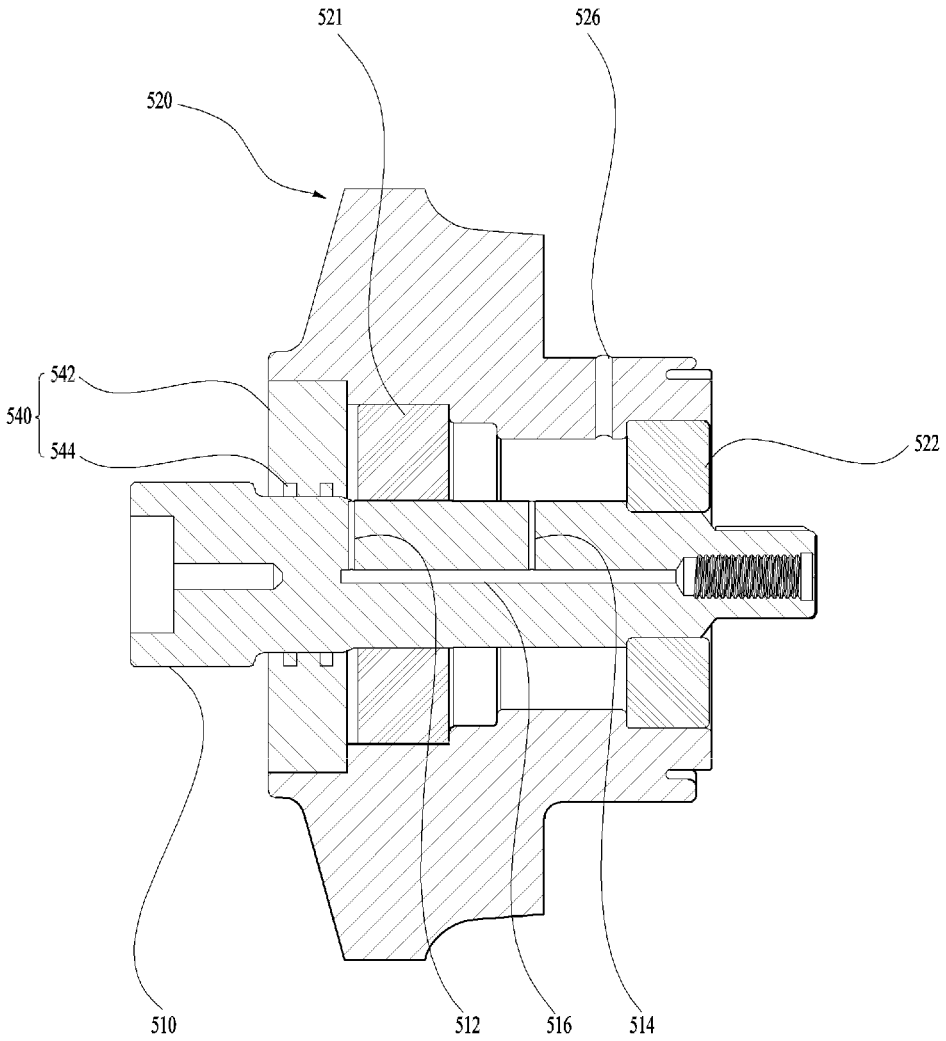
FIG. 17 is a diagram illustrating an example state in which the rotary shaft of FIG. 16 is coupled to other elements.

FIG. 16 is a diagram illustrating the rotary shaft. FIG. 17 is a diagram illustrating an exemplary state in which the rotary shaft of FIG. 16 is coupled to other constituent elements.

A rotary shaft 510 having one side coupled to the drum 350 and the other side coupled to the rotor 550 can be provided at the center of the bearing housing 520. The rotary shaft 510 can be disposed to pass through the center of the bearing housing 520.

The rotary shaft 510 can be supported by the bearing housing 520 through the first bearing 521 and the second bearing 522. The rotary shaft 510 can be supported to be rotatable by the two bearings. In this case, the two bearings can be implemented as various shapes of bearings as long as they are rotatably supported components.

In some examples, the first bearing 521 and the second bearing 522 can have different sizes, so that the first bearing 521 and the second bearing 522 can stably support the rotary shaft 510. In some examples, the shape of the rotary shaft 510 corresponding to a portion supported by the first bearing 521 can be formed differently from the shape of the rotary shaft 510 corresponding to a portion supported by the second bearing 522 as needed.

A sealing portion 540 can be provided at one side of the first bearing 521. The sealing portion 540 can be disposed along the circumferential surface of the rotary shaft 510. The sealing portion 540 can be disposed to be exposed to the space formed by the first housing 100 and the barrier 400, so that carbon dioxide can be prevented from moving through a gap between the rotary shaft 510 and the bearing housing 520. Specifically, the sealing portion 540 can prevent liquid carbon dioxide from moving into the space opposite to the barrier 400.

The sealing portion 540 can include a shaft-seal housing 542 that is disposed between the rotary shaft 510 and a hole through which the rotary shaft 510 passes, so that the shaft-seal housing 542 can seal a gap between the rotary shaft 510 and the hole. A shaft seal 544 can be disposed at a portion where the shaft-seal housing 542 and the rotary shaft 510 meet each other, thereby improving sealing force. The shaft seal 544 can be disposed to surround the circumferential surface of the rotary shaft 510.

The bearing housing 520 can be formed with a communication hole 526 through which inflow or outflow of external air is possible. The communication hole 526 of the bearing housing 520 can be exposed to the space partitioned by the second housing 200 and the barrier 400.

The rotary shaft 510 can be provided with a first flow passage 512 and a second flow passage 514 spaced apart from each other such that inflow or outflow of air is possible through the first flow passage 512 and the second flow passage 514. At this time, the first flow passage 512 and the second flow passage 514 can be formed in a radial direction from the center of the rotary shaft 510.

Air in the space partitioned by the second housing 200 and the barrier 400 can flow into the rotary shaft 510 through the first flow passage 512 and the second flow passage 514.

In particular, a connection flow passage 516 for connecting the first flow passage 512 to the second flow passage 514 can be formed. The connection flow passage 516 can be disposed at the center of rotation of the rotary shaft 510, and can be vertically connected to each of the first flow passage 512 and the second flow passage 514.

In some examples, where the connection flow passage 516 does not exist, each of the first flow passage 512 and the second flow passage 514 may be perforated on the outer surface of the rotary shaft 510, but the opposite side of each of the first flow passage 512 and the second flow passage 514 may be closed. Therefore, it may be difficult for air to substantially flow into the first flow passage 512 or the second flow passage 514. In some examples, the connection flow passage 516 for interconnecting two flow passages can be formed. Thus, when the internal pressure of the rotary shaft 510 is changed, air can more easily flow into the first flow passage 512, the second flow passage 514, and the connection flow passage 516, so that pressure of the rotary shaft 510 can be maintained in the same manner as the external pressure change.

The rotary shaft 510 can rotate in a state in which one side of the rotary shaft 510 is fixed to the drum 350 and the other side of the rotary shaft 510 is fixed to the rotor 550. Therefore, noise or vibration can occur in the rotary shaft 510. If the rotary shaft 510 rotates at a place where there occurs a pressure deviation, noise or vibration can unavoidably increase. Therefore, in some implementations, the rotary shaft 510 can be formed with a communication hole 526 through which air can flow into the bearing housing 520. The bearing housing 520 is a relatively large component and has a space for allowing air to enter and circulate therein, so that air can be introduced without distinction between the air inlet and the air outlet.

In some examples, the rotary shaft 510 can be made of a material having high rigidity, but the strength of the rotary shaft 510 is reduced so that it is difficult to secure the space in which air can easily flow, thereby increasing the size of the air passage. Therefore, the plurality of flow passages can be coupled to each other, resulting in formation of a path through which the introduced air can be discharged through the opposite flow passage.

In some implementations, the washing chamber 10 can be coupled to the first housing 100 and the second housing 200, resulting in formation of a sealed space. At this time, the sealed space can be divided into two spaces by the barrier 400. Based on the barrier 400, one space can be a space for laundry treatment, and the other space can be a space for installation of the motor or the like.

Figure 18:
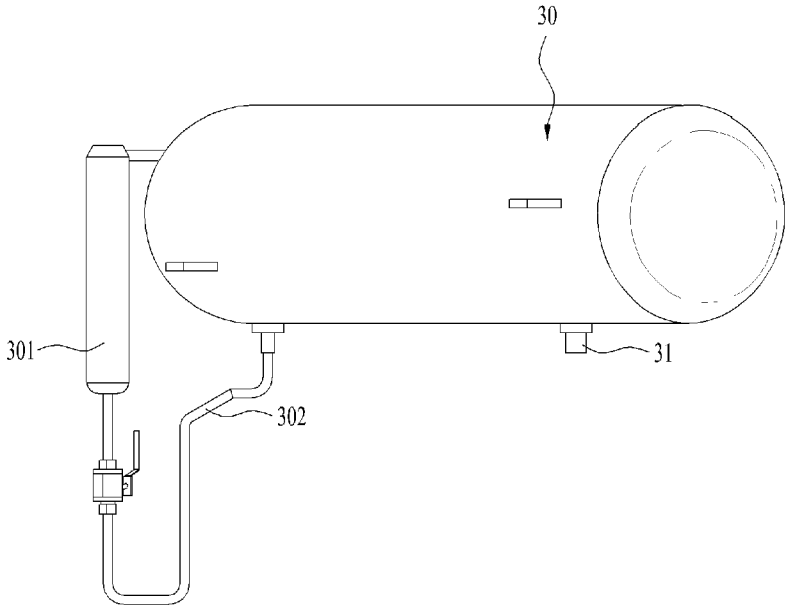
FIG. 18 is a diagram illustrating examples of a storage tank and a storage level sensor.

FIG. 18 is a diagram illustrating a storage tank 30 and a storage level sensor 301.

Referring to FIG. 18, the storage tank 30 in which liquid carbon dioxide and gaseous carbon dioxide can be stored together can include a storage level sensor 301 capable of measuring the height (i.e., a storage level) of liquid carbon dioxide stored in the storage tank 30. The storage level sensor 301 can be installed in a pipe 302 formed to penetrate the storage tank 30, so that the storage level sensor 301 can detect the height of liquid carbon dioxide stored in the storage tank 30. That is, both ends of the pipe 302 can be coupled to the storage tank 30, so that the storage level within the pipe 302 can be maintained at the same storage level within the storage tank 30 and at the same time the height of liquid carbon dioxide can be detected by the storage level sensor 301. In some implementations, it can also be possible to sense the height of liquid carbon dioxide stored in the storage tank using another type of the storage level sensor 301.

A supply pipe 31 for guiding liquid carbon dioxide to the storage tank 30 can be disposed at a lower portion of the storage tank 30 in a manner that the supply pipe 31 can pass through the storage tank 30. The supply pipe 31 can guide liquid carbon dioxide, which is liquefied through the distillation chamber 50 and the cooler 40, to flow into the storage tank 30.

Figure 19:
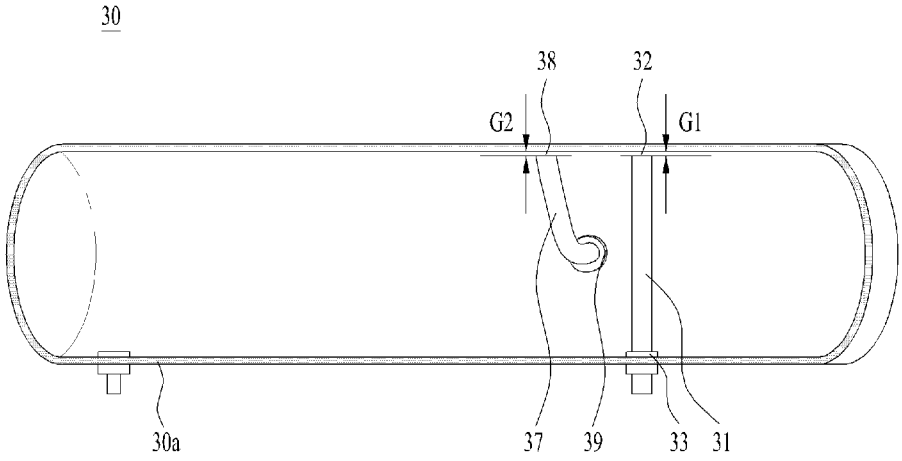
FIG. 19 is a cross-sectional view illustrating the storage tank.

FIG. 19 is a cross-sectional view illustrating the storage tank. Referring to FIG. 19, the storage tank 30 can include a case 30*a* forming an outer appearance thereof, an outlet 32 disposed at a height higher than the height of liquid carbon dioxide stored in the case 30*a*, and a supply pipe 31 for supplying liquid carbon dioxide to the case 30*a*. The case 30*a* can be formed of a metal material, resulting in formation of a pressure vessel in which liquid carbon dioxide stored therein can be maintained at high pressure.

The storage tank 30 can be formed in a cylindrical shape, and can be installed such that a circular surface is disposed at a side surface of the storage tank 30. That is, the storage tank 30 can be installed in the washing machine while formed in a horizontal cylindrical shape. Therefore, as the amount of liquid carbon dioxide stored in the storage tank 30 increases, the storage level of liquid carbon dioxide stored in the storage tank 30 can increase upward from the bottom surface of the storage tank 30.

The supply pipe 31 can be disposed to penetrate the bottom surface of the case 30*a*. The supply pipe 31 can include a portion 33 penetrating the storage tank 30. At this time, the portion 33 penetrating the storage tank 30 can be formed to penetrate the bottom surface of the storage tank 30. The penetrating portion 33 can be welded to the storage tank 30, so that carbon dioxide can be prevented from leaking between the portion 33 and the storage tank 30. The supply pipe 31 can extend in a direction perpendicular to the portion 33. That is, some parts of the supply pipe 31 and the portion 33 can always be submerged in liquid carbon dioxide stored in the storage tank 30.

The supply pipe 31 can extend higher from the bottom surface of the case 30*a* than the maximum height of stored liquid carbon dioxide. The storage tank 30 can be designed to withstand pressure at which liquid carbon dioxide can be stably stored. Therefore, the amount of liquid carbon dioxide that can be stored in the storage tank 30 can be predetermined, and a maximum storage level of such liquid carbon dioxide stored in the storage tank 30 can also be predetermined. Therefore, the supply pipe 31 can be formed to extend higher than the maximum storage level. The outlet 32 can be provided at the end of the supply pipe 31. Here, the outlet 32 can be disposed higher than the maximum storage level. Through the outlet 32, liquid carbon dioxide guided to the storage tank 30 can be ejected into the storage tank 30.

The outlet 32 can be disposed to be spaced apart from the ceiling of the storage tank 30 by a predetermined distance G1. Accordingly, the level of liquid carbon dioxide flowing through the outlet 32 first rises to a position near the outlet 32, and then flows into the storage tank 30.

Since the outlet 32 is disposed higher than the maximum level of liquid carbon dioxide, liquid carbon dioxide supplied through the outlet 32 may not generate waves that cause the level of liquid carbon dioxide stored in the storage tank 30 to fluctuate. Therefore, since liquid carbon dioxide flowing down through the outlet 32 gradually increases the level of stored liquid carbon dioxide, it is possible to accurately measure the level using the storage level sensor 301.

In some examples, carbon dioxide supplied through the outlet 32 can flow down along the inner wall of the case 30*a*, so that the carbon dioxide can be mixed with the stored liquid carbon dioxide. Even in this case, since fluctuations that periodically shake the storage liquid carbon dioxide do not occur, occurrence of an error in which the storage level of liquid carbon dioxide detected by the storage level sensor 301 periodically rises and falls can be prevented.

The storage tank 30 can include a pipe 37 through which gaseous carbon dioxide is supplied or discharged after passing through the storage tank 30. Here, the pipe 37 can include a portion 39 that penetrates a side surface of the storage tank 30.

The portion 39 where the pipe 37 penetrates the storage tank 30 can be located lower than the ceiling of the storage tank 30. The penetrating portion 39 should protrude to the outside of the storage tank 30. Since the pipe 37 does not penetrate the ceiling of the storage tank 30, a portion formed to protrude upward from the storage tank 30 may not be formed due to presence of the pipe 37. Accordingly, in some implementations, the space in which a structure located higher than the storage tank 30 is disposed may not be provided outside the storage tank 30, so that the overall size of the washing machine including the storage tank can be reduced.

In some implementations, the portion 39, where the pipe 37 penetrates the storage tank 30, can be disposed higher than the middle of the storage tank 30. The storage tank 30 is disposed in a horizontal cylindrical shape formed when the cylinder is laid down. At this time, a portion corresponding to the middle height of the horizontal cylindrical shape has the largest width. As a result, in order for the portion 39 to be disposed at the middle of the horizontal cylindrical shape, the space in which the storage tank is to be disposed should increase in width. Therefore, if the portion 39 is located higher than the middle of the storage tank 30, the length of the increased width of the storage tank is shortened, so that the washing machine can be installed compactly in a smaller or narrower space.

A through-hole 38 of the pipe 37 can be disposed higher than the maximum height of liquid carbon dioxide that can be stored in the storage tank 30. Through the through-hole 38, gaseous carbon dioxide can flow into the storage tank 30, or can be discharged from the storage tank 30. Accordingly, if the through-hole 38 is submerged below the storage level of liquid carbon dioxide stored in the storage tank 30, gaseous carbon dioxide cannot move or flow. In some implementations, the through-hole 38 may not be submerged in liquid carbon dioxide, so that a movement path of gaseous carbon dioxide moving within the storage tank 30 can be secured.

In some implementations, the pipe 37 can extend upward from the penetrating portion 39, and can enable the through-hole 38 to be disposed higher than the maximum storage level. At this time, the through-hole 38 can be disposed to have a gap G2 from the ceiling of the storage tank 30, so that gaseous carbon dioxide can flow into the through-hole 38.

The penetrating portion 39 can be disposed lower than the through-hole 38, so that some parts of the pipe 37 can be submerged in liquid carbon dioxide.

Figure 20A:
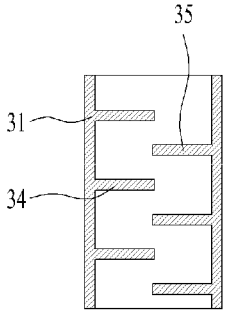
FIGS. 20A to 20C are diagrams illustrating an example of a supply pipe.
Figure 20B:
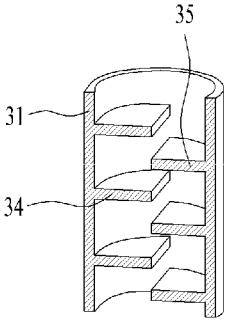
Figure 20C:
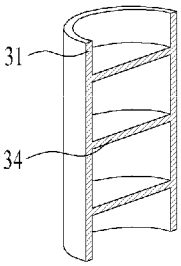

FIGS. 20A to 20C are diagrams illustrating an example of the supply pipe. FIGS. 20A, 20B, and 20C are cross-sectional views illustrating the same supply pipe from different directions. The supply pipe, shown in FIGS. 20A to 20C, can be a portion of the supply pipe, so that the supply pipe shown in FIGS. 20A to 20C can also mean a portion corresponding to an intermediate position of the supply pipe, or can be interpreted as representing the entire supply pipe.

Referring to FIGS. 20A to 20C, the supply pipe 31 can be provided with a plurality of baffles 34 and 35 disposed therein. Each of the baffles 34 and 35 can protrude inward from the supply pipe 31. The supply pipe 31 can be formed to have a circular cross-section, so that each of the baffles 34 and 35 can be formed in a semicircular shape. At this time, the baffles can include a first baffle 34 and a second baffle 35 which are alternately arranged. Whereas two baffles are disposed at different heights, the two baffles can be arranged to face each other, thereby generating resistance in liquid carbon dioxide moving within the supply pipe 31. Therefore, sudden speed change caused by abrupt pressure change of such liquid carbon dioxide can be reduced, so that high pressure of liquid carbon dioxide discharged through the outlet 32 can be reduced. That is, the movement path of liquid carbon dioxide moving in the supply pipe becomes longer.

That is, one or more baffles can be formed in the supply pipe inserted into the storage tank so that the flow rate and noise of liquid carbon dioxide introduced into the storage tank are reduced, thereby more stably controlling the fluid level of the liquid carbon dioxide stored in the storage tank.

Figure 21A:
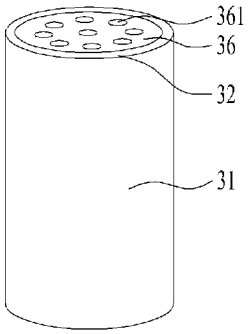
FIGS. 21A and 21B are diagrams illustrating an example of the supply pipe.
Figure 21B:
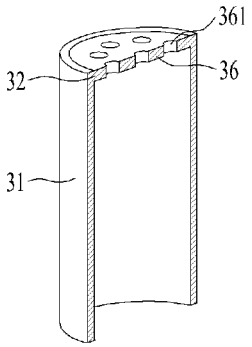

FIGS. 21A and 21B are diagrams illustrating another example of the supply pipe. FIG. 21A is a diagram illustrating an upper end of the supply pipe, and FIG. 21B is a view illustrating the upper end of the supply pipe, and FIG. 21B is a view illustrating the center portion of the structure shown in FIG. 21A while taken along the center line of FIG. 21A.

Referring to FIGS. 21A and 21B, a cover 36 having a plurality of holes 361 can be provided in the outlet 32. The cover 36 can help to prevent the outlet 32 from being exposed to the storage tank 30 without change, and can allow liquid carbon dioxide to be discharged through a plurality of holes 361.

Therefore, in a similar way to the baffles described above, the cover 36 can help to prevent liquid carbon dioxide from flowing into the storage tank 30 within a short period of time, so that fluctuations of the storage level caused by such liquid carbon dioxide flowing into the storage tank 30 can be prevented. As a result, a change in storage level of the liquid carbon dioxide measured by the storage level sensor 301 can be reduced, thereby improving reliability of the measured level value.

In other words, the through-hole 38 of the storage tank 30 of the pipe inserted into the storage tank 30 can have a porous structure, so that liquid carbon dioxide can be discharged from the outlet location through such porous structure, thereby dispersing fluid energy. Therefore, liquid carbon dioxide flows down along the inner surface of the storage tank 30, so that fluid excitation force becomes smaller, resulting in reduction in fluctuations of the fluid surface.

As is apparent from the above description, the washing machine can reduce the amount of carbon dioxide to be used so that the amount of residual carbon dioxide to be reprocessed after use can also be reduced, resulting in improvement in energy efficiency of the entire system. In addition, since the amount of carbon dioxide to be used is reduced, the size of a storage tank that should store carbon dioxide before use can also be reduced, so that the overall size of the washing machine can be reduced.

In particular, the amount of carbon dioxide to be used in the washing machine can be reduced as compared to the prior art, so that the amount of carbon dioxide to be reprocessed after use can also be reduced. As the amount of carbon dioxide to be used is reduced, the overall size of the washing machine for using carbon dioxide as well as the capacity of a storage tank storing carbon dioxide can be reduced. In addition, since the amount of carbon dioxide to be reprocessed after use is reduced, the time for the washing or rinsing operation can also be reduced.

In some implementations, the washing machine is constructed in a manner that various constituent elements can be separated from the washing machine so that an operator (or a repairman) can easily access and repair one or more component from among the constituent elements. In addition, the washing machine can provide a structure in which various constituent elements can be combined to produce an actual product, so that the operator can easily manufacture the washing machine designed to use carbon dioxide.

In some implementations, a stator and a rotor are disposed together around a rotary shaft configured to rotate the drum, and the space to be occupied by a motor assembly is reduced in size, so that the overall size of the washing machine can also be reduced. In addition, the coupling relationship of the constituent elements for rotating the drum is simplified, so that noise generated by rotation of the drum can be reduced and the efficiency of power transmission can increase.

In some implementations, where liquid carbon dioxide may not be introduced into the driving space in which the motor is disposed, and gaseous carbon dioxide can flow into the driving space, the drum can be rotated in a state in which pressure equilibrium between the washing space and the driving space is maintained. Therefore, when the washing machine operates, the drum can stably rotate. In addition, since the driving space is filled with gaseous carbon dioxide, the amount of carbon dioxide to be used for laundry treatment such as washing can be reduced.

In some implementations, liquid carbon dioxide discharged into the storage tank may not generate a large change in the storage level of liquid carbon dioxide stored in the storage tank, so that the storage level of the liquid carbon dioxide stored in the storage tank can be accurately detected.

In some implementations, the storage tank can be reduced in size, so that the space for installing the washing machine can also be reduced in size.

It will be apparent to those skilled in the art that the present disclosure can be implemented in other specific forms without departing from the spirit and essential characteristics of the disclosure. Thus, the above implementations are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A washing machine configured to perform washing using carbon dioxide, the washing machine comprising:

a first housing that defines an opening and an inner space;

a drum disposed in the inner space of the first housing and configured to receive laundry;

a barrier that is coupled to the first housing and seals the opening of the first housing;

a motor assembly coupled to a surface of the barrier, the motor assembly comprising a stator, a rotor, and a bearing housing;

a rotary shaft disposed in the bearing housing, the rotary shaft having (i) a first end coupled to the rotor and (ii) a second end coupled to the drum; and a second housing that faces the surface of the barrier and is coupled to the first housing, the second housing accommodating the motor assembly, wherein the barrier defines (i) a first space between the first housing and the barrier and (ii) a second space between the second housing and the barrier, the barrier being configured to block liquid carbon dioxide injected into the first space from leaking into the second space, and wherein the barrier includes:

a first through-hole that receives the rotary shaft, and a second through-hole defined above the first through-hole, the barrier being configured to allow flow of gaseous carbon dioxide between the first space and the second space via the second through-hole.

2. The washing machine according to claim 1, wherein the first housing comprises a first flange disposed along the opening of the first housing, the first flange defining a seating groove that is coupled to the barrier and extends along the opening, and wherein the second housing comprises a second flange coupled to the first flange.

3. The washing machine according to claim 1, further comprising:

a heat exchanger coupled to the barrier; and a refrigerant pipe that passes through the second through-hole and is configured to supply a refrigerant to the heat exchanger.

4. The washing machine according to claim 1, wherein the barrier comprises a heat exchanger disposed in the first space, the heat exchanger being configured to communicate a refrigerant therethrough.

5. The washing machine according to claim 1, further comprising:

a sealing portion that is disposed around the rotary shaft and exposed to the first space.

6. The washing machine according to claim 1, wherein the bearing housing defines a communication hole configured to communicate air with an outside of the bearing housing.

7. The washing machine according to claim 6, wherein the rotary shaft defines a first flow passage and a second flow passage that are spaced apart from each other, each of the first flow passage and the second flow passage being configured to communicate inflow or outflow of the air therethrough.

8. The washing machine according to claim 7, wherein the first flow passage and the second flow passage extend in a radial direction away from a center portion of the rotary shaft.

9. The washing machine according to claim 8, wherein the rotary shaft further defines a connection flow passage that connects the first flow passage and the second flow passage to each other.

10. The washing machine according to claim 9, wherein the connection flow passage is disposed at a center of rotation of the rotary shaft and extends in a direction perpendicular to the radial direction.

11. The washing machine according to claim 1, further comprising:

a storage tank configured to store carbon dioxide to be supplied to the drum;

a distillation chamber configured to receive liquid carbon dioxide used in the drum;

a filter configured to filter contaminants from the liquid carbon dioxide used in the drum; and a compressor configured to reduce gas pressure inside the drum.

12. The washing machine according to claim 1, wherein the first housing and the second housing are coupled to each other and defines a closed space, and wherein the barrier divides the closed space into the first space and the second space.

13. The washing machine according to claim 1, wherein the stator, the rotor, and the bearing housing are disposed in the second space between the second housing and the barrier.

14. The washing machine according to claim 1, wherein the rotary shaft passes through the bearing housing and the barrier.

15. The washing machine according to claim 1, wherein the motor assembly is coupled to a center portion of the barrier, and wherein the rotary shaft passes through the center portion of the barrier.

* * * * *